United States Patent [19]

Kiselev et al.

[11] Patent Number: 4,987,707

[45] Date of Patent: Jan. 29, 1991

[54] VAULTED BUILDING STRUCTURE

[76] Inventors: Vasily P. Kiselev, Moskovsky prospekt, 54, kv. 7; Nikolai P. Klimenko, ulitsa Putilovskaya, II, kv.9; Alexandr A. Zakharov, ulitsa Generala Lizjukova, 28, kv. I2, all of Voronezh, U.S.S.R.

[21] Appl. No.: 458,700

[22] PCT Filed: Jan. 27, 1988

[86] PCT No.: PCT/SU88/00022

§ 371 Date: Sep. 27, 1989

§ 102(e) Date: Sep. 27, 1989

[87] PCT Pub. No.: WO89/07179

PCT Pub. Date: Aug. 10, 1989

[51] Int. Cl.[5] ..... E04B 1/32; E04B 7/08

[52] U.S. Cl. ..... 52/88; 52/82; 52/86; 52/89

[58] Field of Search ..... 52/82, 86, 88, 89

[56] References Cited

U.S. PATENT DOCUMENTS

| | | | |
|---|---|---|---|
| 3,118,010 | 1/1964 | Harrington | 52/86 |
| 3,154,888 | 11/1964 | Graham | 52/88 |

FOREIGN PATENT DOCUMENTS

| | | | |
|---|---|---|---|
| 442793 | 4/1927 | Fed. Rep. of Germany . | |
| 961303 | 3/1957 | Fed. Rep. of Germany | 52/86 |
| 2026905 | 8/1972 | Fed. Rep. of Germany . | |
| 1529330 | 6/1967 | France . | |
| 958608 | 9/1982 | U.S.S.R. . | |

*Primary Examiner*—Richard E. Chilcot, Jr.
*Assistant Examiner*—Deborah M. Ripley
*Attorney, Agent, or Firm*—Fleit, Jacobson, Cohn, Price, Holman & Stern

[57] ABSTRACT

The vaulted building structure comprises a shell (1) made of a composite construction material and formed of arcuate elements (4) of a uniform width having their ends (5) mounted on a base (3). The shell (1) is shaped as a cylindrical vault of which the vertical axis of symmetry includes a vault ridge (2). The ends (5) of the arcuate elements (4) are hingedly braced to the base (3) for rotation about a horizontal axis parallel with the vertical plane of symmetry. The convex outer surface of each arcuate element (4) has its curvature gradually diminishing lengthwise of the arcuate element (4) towards its ends (5) and ridge (2) for levelling out strains generated in the shell (1) upon rotation of the ends (5) of the arcuate elements (4).

3 Claims, 2 Drawing Sheets

VAULTED BUILDING STRUCTURE

BACKGROUND OF THE INVENTION

The invention relates to construction and to building structures, and more particularly it relates to a vaulted building structure.

FIELD OF THE INVENTION

It is generally known that the cost of construction of vaulted building structures is significantly lower than of framed structures; thus, the input of concrete is lower by 25–30% and of steel by up to 25%, and the total cost is lower by 12 to 14%. On the other hand, the input of steel into ferroconcrete structures is 4 to 5 times less than into buildings with all-metal structures.

The construction of monolithic or solid cast-in-situ building structures requires extended construction facilities and is economically feasible only in industrially developed areas.

Contractors have accumulated considerable experience in erecting the shells of vaulted buildings and structures, such as the domes and ceilings of production shops, pavilions, grain storages, hangars, minor sports halls and auditoriums made of individual components, e.g. with the use of panel shells.

The use of panel shells in construction yields considerable savings when vaulted building structures are erected.

In general, the industrial manufacture and use of panel shells in construction have been found to yield sizeable economy and to save the input of both materials and labour.

However, a vaulted building structure made of panel shells requires a load-bearing skeleton or cage, in most cases made of metal, and its construction involves the sealing of joints and application of waterproofing coatings.

The thickness of the shell of a vaulted building structure is determined from calculations accounting for the total load applied to the shell, the strength ratings of the construction material used and of the metal reinforcement. The common practice is to arrange the metal reinforcement closer to either the outer or inner surface of the shell, and to apply a protecting coating 10–15 mm thick to safeguard the reinforcement against corrosion.

Due to relatively large dimensions vaulted building structures are in most cases constructed on supports. The general practice is to make individual panel shells at manufacturing works and then to ship them to the construction site where diverse handling equipment is operated to assemble them into a vaulted building structure. Consequently, the design of the panel shells has to provide for shipment and handling loads, which generally results in an increased input of materials into the structures. The same problems are encountered when shells are constructed without a load-bearing cage.

As it has been already mentioned, the use of structures made of panel shells is not economically feasible in areas remote from the construction industry centres, on account of the problems encountered in erecting such structures, concerning both the shipment cost and the complexity of the assembly work requiring specific handling equipment. These extra costs can be as high as 50 to 200% of the cost of the structure itself.

The load-bearing capacity of thin-wall shells is dependent on their strength, rigidity and stability, and, consequently, the service life of vaulted structures is dependent on the geometric shape and dimensions of such shells.

High load-bearing capacity is offered by thin-wall shells of vaulted building structures of the cylindrical type, made of jointed arcuate elements with a convex outer surface having their ends bearing upon a base. The central angle of such arcuate elements is generally from 130° to 150° , the width of the arcuate element being uniform throughout its length. The actual geometric dimensions of arcuate elements, i.e. their width and the curvature radius of the outer surface are dependent on the dimensions (the length and height) of the vaulted structures, defined by their intended use.

There is known a vaulted building structure comprising a shell of a composite construction material, formed by arcuate elements of a uniform width with a convex outer surface, having their ends bearing upon the base, the structure being shaped as a cylindrical vault of which the vertical plane of symmetry includes the ridge of the vault. The outer convex surface of each arcuate element has a uniform curvature, and, hence, the rigidity of the shell is also uniform throughout its length. Each arcuate element is made of two indentical parts hingedly joined at the ridge. The ends of the arcuate elements are made fast with the base.

In constructing this vaulted building structure, the shell is assembled from individual arcuate elements, and their joints are sealed, which involves a considerable input of labour into the construction, and also a large input of the composite construction material, to say nothing of the necessity of having specific equipment for performing the jobs of sealing the joints and the shell. The presence of a hinge at the ridge involves extra constraints in the structure. The stability of a structure of this kind against external action is not high. Thus, in the places where the ends of the arcuate elements are secured, the action of external loads generates a great bending moment which could lead to a strained state of the shell capable of causing its breakdown, one of the main external actions ultimately causing a breakdown of the shell being its surface heating.

The above described design of a vaulted building structure renders impossible making its shell solid, e.g. cast in situ, as the load-bearing capacity of such a shell is inadequate, and the setting of a composite construction material applied on a formwork shaped as the shell-to-be results in exceedingly high shrinkage strain which is at least 5 times greater than the strain under the action of external loads.

SUMMARY OF THE INVENTION

The present invention aims at providing a vaulted building structure, having such a connection between the ends of arcuate elements and a base, and such an outer surface of the arcuate elements as to ensure an increased load-bearing capacity of its shell with simultaneous reduction of the cost of its construction.

With this aim in view, the present invention resides in a vaulted building structure having its shell made of a composite construction material and formed of arcuate elements of a uniform width with a convex outer surface, having their ends mounted on a base, the shell being shaped as a cylindrical vault of which the vertical plane of symmetry includes the ridge of the vault; the ends of the arcuate elements being hingedly braced to the base for rotation about a horizontal axis parallel with the vertical plane of symmetry; the outer surface of each arcuate element having its curvature gradually diminishing lengthwise of the arcuate element towards its ends and the ridge for levelling out the strain generated in the shell during rotation of the ends of the arcuate elements.

It is expedient that in the vaulted building structure the arcuate elements should be substantially arrow-shaped, retaining this shape upon rotation of the end of the arcuate elements.

It is further reasonable that in the vaulted building structure the shell should have its thickness gradually increasing lengthwise of each arcuate element from the ridge towards the respective ends of the arcuate element.

The hinged bracing of the shell with the base ensures that when the shell is strained under the action of the loads exerted thereupon, the ends of the arcuate elements are capable of rotation about the horizontal axis of the hinge parallel with the vertical plane of symmetry of the shell, the bending moment generated by the action of external loads at the hinge substantially equalling zero.

As it has been already mentioned, when the ends of arcuate elements are rigidly secured, the bending moment generated at the cross-section of the arcuate element at the base is 5 times as great as the bending moment generated at the most threatened cross-section of the arcuate element of the disclosed vaulted building structure. Thus, the introduction of the support hinges levels out the bending moment along the neutral line of the arcuate element, enhancing the load-bearing capacity of the structure. The smooth variation of the curvature of the convex outer surface of the arcuate element reduces, respectively, the rigidity of the shell at sections situated at the ridge and at the ends of the arcuate elements, with the strain caused by external forces growing, and the temperature-induced strain lowering. The total strain in the shell would lower, stepping up the safety factor of the shell, and hence, the load-bearing capacity of the arcuate building structure as a whole. The enhanced safety factor of the structure allows to make the shell of the disclosed vaulted building structure solid, e.g. cast in situ with the aid of shotcreating and pneumatic formwork. With the curvature of the ends of the arcuate elements being relatively small, the hinged bracing of the ends of the arcuate elements with the base is relatively easily attained.

As it has been mentioned, when a shell is made by being cast in situ, the setting of the composite construction material generates a shrinkage strain which is substantially greater than the strain caused by the action of external forces and the weight of the structure, the strain being at its utmost at the sections adjoining the ridge of the shell. The arrow-like shape of the arcuate element in combination with the minimized thickness of the shell at the sections adjoining the ridge enhances still further the strength of the solid shell and the load-bearing capacity of the vaulted building structure.

BRIEF DESCRIPTION OF THE DRAWINGS

The present invention will be further described in connection with its preferred embodiments, with reference being made to the accompanying drawings, wherein.

DESCRIPTION OF PREFERRED EMBODIMENTS

Figure 1:
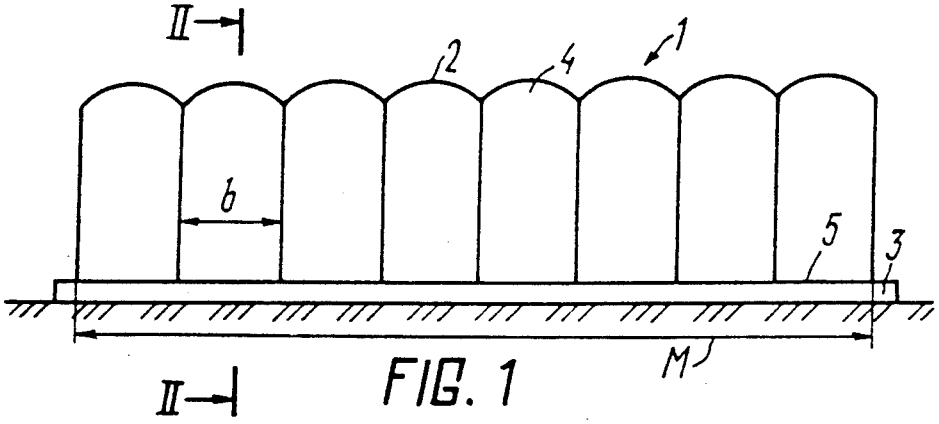
FIG. 1 is a general side view of a vaulted building structure embodying the invention.

In the drawings, the proposed vaulted building structure comprises a shell 1 (FIG. 1) of a composite construction material which can be a construction material based on a cement binder reinforced with glass fibre resistant to the cement medium, with fillers, such as sand, cinders and other additives.

The shell 1 is shaped as a cylindrical vault with the vertical axis of symmetry including the ridge 2 of the vault. The shell 1 is mounted on a base 3 and is formed of jointed arcuate elements 4 having their ends 5 braced with the base 3.

Depending on the soil characteristics and the intended use of the structure, the base 3 can be either a strip foundation with piles or a cast-in-situ ferro-concrete rectangular platform. The width "b" of the arcuate elements 4 is uniform throughout their length, its actual size depending on the strength characteristics of the composite construction material used, the length "M" of the vaulted building structure and its span. In practice, the width "b" of the arcuate element 4 can be from 1 m to 5 m. The number of the arcuate elements 4 in the structure is also dependent on the length "M" of the vaulted building structure and the width "b" of a single arcuate element 4, and it may be various. In the embodiment illustrated in FIG. 1 the number of the arcuate building elements 4 is eight.

The central angle of the arcuate elements 4 is selected from a range of 150° to 180°. The ends 5 (FIG. 2) of the arcuate elements 4 are associated with cylindrical bearing hinges 6 providing for rotation of the ends 5 of the arcuate elements 4 about a horizontal axis parallel with the vertical plane of symmetry of the vault.

Figure 3:
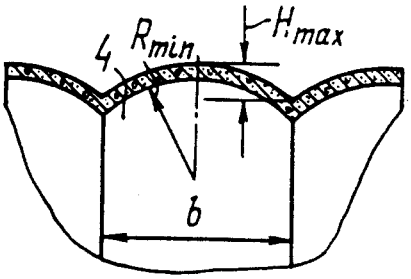
FIG. 3 shows in more detail a sectional view taken on line III—III of FIG. 2.
Figure 4:
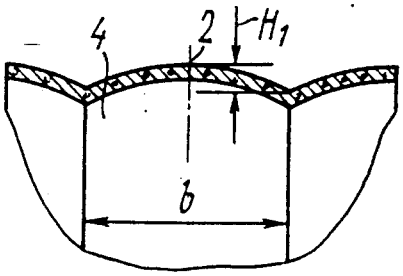
FIG. 4 shows in more detail a sectional view taken on line IV—IV of FIG. 2.
Figure 5:
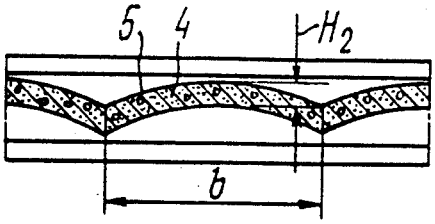
FIG. 5 shows in more detail a sectional view taken on line V—V of FIG. 2.

The arcuate elements 4 have a convex outer surface shaped as a body of revolution. Thus, in the embodiment being described the outer surface of the arcuate elements 4 is toroidal. The curvature of the outer surface of each arcuate element 4 gradually varies lengthwise of each element 4 for levelling out the strain generated in the shell 1 as the ends 5 of the arcuate elements rotate under the load. It is generally known that loads acting upon the shell 1 of a vaulted building structure are the effects of winds and snow, its own weight, temperature-induced and shrinkage strain —both during the setting of the composite construction material of the shell 1 and during the service life of the vaulted building structure. The curvature "K" of the outer surface of each arcuate element 4 is at its maximum at the section of the arcuate element 4 along the portion covering from ⅓ to ⅔ of the length "L" of the arcuate element 4 between the end 5 and the ridge 2 thereof (i.e. along the portion representing the middle third of the length "L" of one side of the arcuate element 4), gradually diminishing towards the ends 5 and ridge 2 of the arcuate element 4. In FIG. 3, $H_{max}$ is the rise of the arc of the circle in section of the arcuate element 4 where its outer surface has the maximum curvature $K_{max} = 1/R_{min}$, where $R_{min}$ is the radius of the outer surface of the arcuate element 4. In FIG. 4, $H_1$ is the rise of the arc of the circle in cross-section of the arcuate element 4 at the ridge 2 of the vault; in FIG. 5, $H_2$ is the rise of the arc of the circle in cross-section at the end 5 of the arcuate element 4.

The values of $H_{max}$, $H_1$ and $H_2$ are determined from computations accounting for the dimensions of the vaulted building structure, the strength characteristics of the composite construction material, the external action, and should satisfy the following conditions:

$$0 \leqq H_1 \leqq 2/5 H_{max};\ 1/5 H_{max} \leqq H_2 \leqq \tfrac{3}{4} H_{max}.$$

Figure 6:
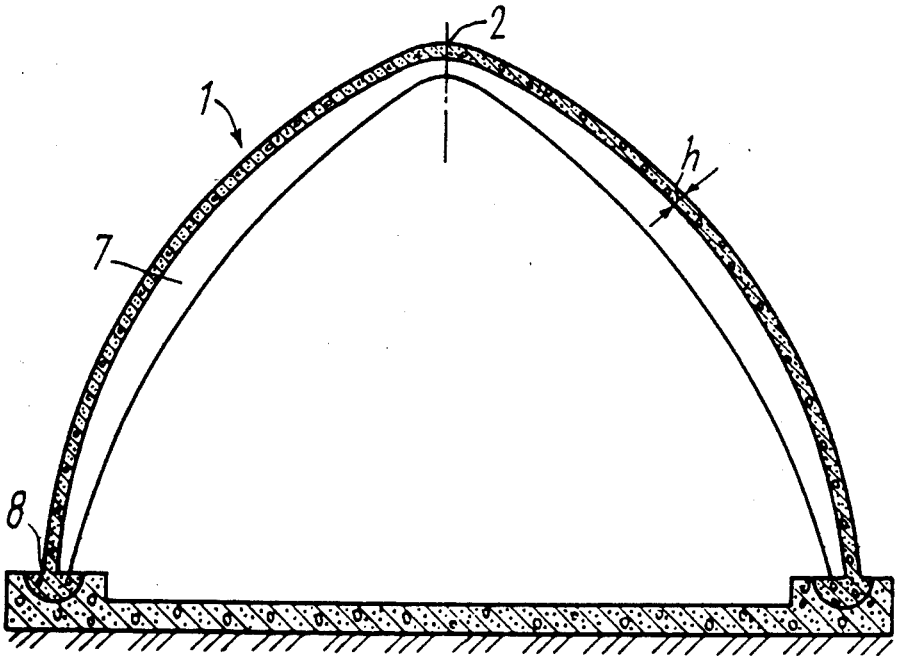
FIG. 6 shows the same, as FIG. 2, for the version of the shell with arrow-shaped arcuate elements, in accordance with the invention.

In the embodiment illustrated in FIG. 6, the arcuate elements 7 of the vaulted building structure have an arrow-like shape retainable upon rotation of their hingedly braced ends 8, which enhances the stability, rigidity and, hence, the load-bearing capacity of the shell 1. The minimum thickness $h_{min}$ of the shell 1 is determined from computations for a given composite construction material and required dimensions of the shell 1 in a known procedure, depending on the external action, the intended use of the structure and climatic conditions.

Figure 2:
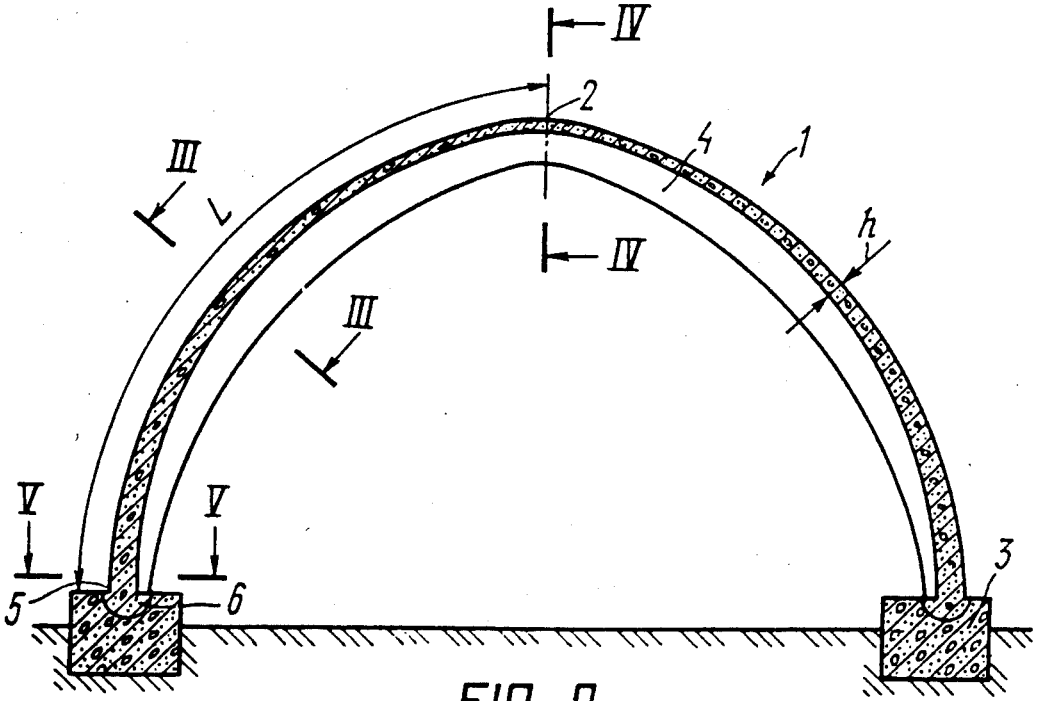
FIG. 2 shows on a larger scale a sectional view taken on line II—II of FIG. 1.

In the embodiment illustrated in FIG. 2, the arcuate elements 4 have a thickness "h" gradually increasing lengthwise of each arcuate element 4 from the ridge 2 towards the ends 5 of the arcuate element 4.

In the disclosed vaulted building structure the action of external loads makes the ends 5 (FIGS. 1 and 2) of the arcuate elements 4 turn in their cylindrical bearing hinges 6 (FIG. 2), so that the shell 1 becomes somewhat deformed with the maximum bending moments being generated at sections at the ridge 2 of the shell 1 and at sections spaced from the ends 5 of the arcuate elements 4 by about 1/7 L. With the rigidity of the shell 1, owing to the varying curvature "K" of its outer surface lengthwise of the arcuate element 4, diminishing towards the ridge 2 and ends 5, the strain produced in the shell 1 is levelled out.

In construction of the shell 1 of the vaulted building structure by casting in situ, the setting of the composite construction material generates shrinkage strain in the shell 1, while oppositely directed horizontally extending reaction forces are generated at the cylindrical bearing hinges 6. With the ends of the arcuate elements 4 being displaced correspondingly, each arcuate element 4 is somewhat bent, and its each section is somewhat turned. Had the curvature of the outer surface of the shell 1 been uniform, the maximum bending moment caused by the shrinkage strain would have been located in the area of the ridge 2. Since in the disclosed structure the curvature of the outer surface of the arcuate element 4 gradually diminishes towards the ridge 2, and, consequently, the height of the cross-section of the arcuate element 4 gradually diminishes towards the ridge 2, the shrinkage strain in the shell 1 is reduced. In other words, with the shell 1 being less rigid and the deformation being of the same magnitude as in the structures of the prior art, the reaction forces at the cylindrical bearing hinges 6 are reduced, and the strain at sections of the arcuate element 4 is likewise reduced. In this way the levelling out of the strain lengthwise of each arcuate element 4 takes place.

In case of temperature-induced strain, the latter generates an effort of thrust at the cylindrical bearing hinges 6, i.e. the reaction forces generated there are opposite to those produced by the shrinkage strain. It should be pointed out that when the shrinkage strain equals the temperature-induced strain, the two strains completely eliminate each other.

In the arrow-shaped vaulted building structure illustrated in FIG. 6, a zone is defined in the vicinity of the ridge 2 which takes up in the best possible way the rotation of the ends 8 of the arcuate components 7, its performance resembling that of a "resilient" hinge, i.e. a hinge where a bending moment is set, proportional to the rotation of the ends 8 of the arcuate elements 7 relative to the ridge 2. In this case the reduction and levelling out of the strain in the shell 1 is optimal.

For the present invention to be better understood, given below are some illustations of its practical implementation.

EXAMPLE 1

The vaulted building structure is 12 m wide, 6 m high, 24 m long, and is intended as a garage for automotive vehicles. It is constructed by casting in situ with the use of a pneumatic formwork by shotcreting a mortar of a composite construction material. The composite construction material—glass—fibre/cement concrete—is produced of a cement mortar reinforced with glass fibre resistant to the cement medium, the average glass fibre length being 40 mm. The percentage of glass fibre in the glass-fibre/cement concrete is 3%. The sand-cement ratio in the mortar is 0.5:1. The water-solid (cement+-sand) ratio is 0.4:1. The shell 1 (FIG. 2) is made of eight arcuate elements 4, 2 cm thick and 3 m wide. The rise $H_1$ of the arc of the circle of the arcuate element 4 at the section at the ridge 2 is 300 mm, and the rise $H_2$ of the arc of the circle at the section at the end 5 of the arcuate element 4 is 100 mm. The rise $H_{max}$ of the arc of the circle at the section of the arcuate element 4, having the maximum curvature, is 600 mm and is spaced from the ends 5 of the arcuate elements 4 by 0.53 L. The strength computations have accounted for the environmental and service conditions of the structure. The shrinkage of the material is 0.002. The computations have shown that the maximum strain is located at the section of the ridge 2 and at a section spaced by $\frac{1}{8}$ 1 from the end 5 of the arcuate element 4. The total strain $\sigma$ at the section of the ridge 2 in the area of the maximum value of its rise is about 42 kg/cm$^2$. In the area of the joints of the arcuate elements 4 the total strain $\sigma$ is $-80$ kg/cm$^2$.

The total strain at the section of the arcuate element 4 spaced by $\frac{1}{8}$ L from the end 5 of the end thereof is, as follows: in the area of the maximum value of the rise $\sigma = -9$ kg/cm$^2$, and in the area of the joints of the arcuate elements 4, $\sigma = 46$ kg/cm$^2$.

It should be mentioned that with the above proportions of the geometric dimensions of the vaulted building structure and with the given construction material, the temperature-induced strain opposes the shrinkage strain and compensates for it. The computations have indicated that the shell 1 would retain its load-bearing capacity when being heated from 1° C. to 40° C.

EXAMPLE 2

The vaulted building structure intended for use as a grain storage has the dimensions of Example 1, with the exception of the thickness of the shell 1 gradually increasing from the ridge 2 toward the ends 5 of the arcuate elements 4 from 25 mm to 40 mm, whereby the strain at the most endangered sections is 10–15% less than in Example 1.

EXAMPLE 3

The vaulted building structure has the dimensions of the Example 1, with the exception of the arcuate elements 7 (FIG. 6) being arrow-shaped, the height of the span being 6.75 m. With this configuration, the strain produced in the shell 1 by winds would grow, the snow load would diminish, the load of the own weight would remain the same. The strain at the section of the ridge 2 caused by shrinkage is 5–8% lower than in the structure of the Example 1. Thus, the arrow-like shape of the shell enhances the load-bearing capacity of the vaulted building structure of the present invention.

INDUSTRIAL APPLICABILITY

The disclosed vaulted building structure can be used in buildings and structures of different kinds, such as grain storages, warehouses, garages, hangars, minor sports halls and auditoriums made of composite construction materials.

We claim:

1. A vaulted building structure having its shell (1) made of a composite construction material and formed of arcuate elements (4) of a uniform width having a convex outer surface, having their ends (5) mounted on a base, the shell being shaped as a cylindrical vault of which the vertical plane of symmetry includes the ridge (2) of the vault, characterized in that the ends (5) of the acruate elements (4) are hingedly braced to the base (9) for rotation about a horizontal axis parallel with the vertical plane of symmetry, the outer surface of each arcuate element (4) having its curvature gradually diminishing lengthwise of the arcuate element (4) toward the ends (5) and the ridge (2) thereby levelling out strains generated in the shell (1) in rotation of the ends (5) of the arcuate elements (4).

2. A vaulted building structure as claimed in claim 1, characterized in that the arcuate elements (7) are of an arrow-like shape retainable upon rotation of the ends (8) of the arcuate elements (7).

3. A vaulted building structure as claimed in claim 1, characterized in that the shell (1) has its thickness gradually increasing lengthwise of each arcuate element (4) from the ridge (2) towards the ends (5) of the arcuate element (4).

* * * * *